US007252331B1

(12) United States Patent
Walton

(10) Patent No.: US 7,252,331 B1
(45) Date of Patent: Aug. 7, 2007

(54) SECURITY BENCH

(75) Inventor: Toby Evans Walton, Washington, MA (US)

(73) Assignee: Dorothy Goodrich Walton, Washington, MA (US)

( * ) Notice: Subject to any disclaimer, the term of this patent is extended or adjusted under 35 U.S.C. 154(b) by 136 days.

(21) Appl. No.: 10/995,579

(22) Filed: Nov. 23, 2004

Related U.S. Application Data

(60) Provisional application No. 60/567,572, filed on May 4, 2004, provisional application No. 60/524,711, filed on Nov. 24, 2003.

(51) Int. Cl.
*A47C 15/00* (2006.01)
*A47C 1/12* (2006.01)
*E01F 15/00* (2006.01)

(52) U.S. Cl. ..... 297/232; 297/452.64; 404/6

(58) Field of Classification Search ..... 297/232, 297/452.64; 404/6; 256/13.1; 52/782.2, 52/783.1, 783.13, 309.11
See application file for complete search history.

(56) References Cited

U.S. PATENT DOCUMENTS

| | | | | |
|---|---|---|---|---|
| D3,610 | S | | 8/1869 | Hutchinson |
| D15,053 | S | | 6/1884 | Hale |
| D25,362 | S | | 4/1896 | Brill |
| D26,068 | S | | 9/1896 | Brill |
| D34,325 | S | | 4/1901 | Kling |
| D38,076 | S | | 6/1906 | Kilburn |
| D38,839 | S | | 9/1907 | Kilburn |
| D67,519 | S | | 6/1925 | Hansen |
| D81,129 | S | | 5/1930 | Fabbro |
| 1,862,382 | A | | 6/1932 | Mathis |
| D96,286 | S | | 7/1935 | Ward, Jr. |
| D99,592 | S | | 5/1936 | Bond, Jr. |
| D105,186 | S | | 6/1937 | Sellers |
| D106,693 | S | | 10/1937 | Loewy |
| D110,563 | S | | 7/1938 | Hurwitz |
| 2,129,211 | A | | 9/1938 | Hickl |
| D113,372 | S | | 2/1939 | Bond, Jr. |
| D118,860 | S | | 2/1940 | Logan |
| D121,870 | S | | 8/1940 | Henkel et al. |
| D123,703 | S | | 11/1940 | Smith |
| D123,901 | S | | 12/1940 | Bond, Jr. |
| D132,348 | S | | 5/1942 | Saltman |
| D145,972 | S | | 11/1946 | Bond, Jr. |
| D148,598 | S | | 2/1948 | Anderson et al. |
| D163,883 | S | | 7/1951 | Lindberg |
| D163,941 | S | | 7/1951 | Frost |
| D169,473 | S | | 5/1953 | Brulin et al. |
| 2,659,422 | A | * | 11/1953 | Holland ..... 297/447.1 |
| 2,711,786 | A | * | 6/1955 | Weiss ..... 297/452.14 |
| D183,508 | S | | 9/1958 | Battle |

(Continued)

*Primary Examiner*—David Dunn
*Assistant Examiner*—Sarah B. McPartlin
(74) *Attorney, Agent, or Firm*—McCormick, Paulding & Huber LLP

(57) ABSTRACT

A security bench for use as a seat and as a defensive barricade against vehicles and explosive force comprises a support base, a framed screen securely attached to and overlapping the top of the base, and a seating surface attached to the top of the framed screen. The base, made of granite, concrete, or the like, is relatively massive, providing resistance to vehicular and explosive force. The frame portion of the framed screen, made from structural steel, reinforces the structural integrity of the base, and, along with the screen (and potentially the seating surface) acts to repel or absorb explosive force or debris.

3 Claims, 9 Drawing Sheets

U.S. PATENT DOCUMENTS 2,993,560 A * 7/1961 Hollomon ..... 182/179.1
D192,243 S 2/1962 Williams
3,032,373 A * 5/1962 Danciart et al. ..... 297/371
D210,364 S 3/1968 Lindberg
D212,292 S 9/1968 Yermakov
3,606,258 A * 9/1971 Fitch ..... 256/13.1
3,676,579 A * 7/1972 Lanoue et al. ..... 174/138 R
3,748,012 A 7/1973 Abelman
3,756,657 A 9/1973 Johnson
D230,116 S 1/1974 Beams
D230,384 S 2/1974 Bialosky
3,887,234 A 6/1975 Curtis et al.
D238,993 S 3/1976 Schultz
D244,735 S 6/1977 Kennedy, Jr. et al.
D247,082 S 1/1978 Thompson et al.
4,165,902 A 8/1979 Ehrlich
D266,386 S 10/1982 DiPersia
4,438,603 A 3/1984 Durkan, Jr.
D303,877 S 10/1989 Norton
D304,527 S 11/1989 Miller
D318,183 S 7/1991 Fister et al.
D326,367 S 5/1992 Messina
5,387,049 A * 2/1995 Duckett ..... 404/6
D360,091 S 7/1995 Hassel et al.
D360,310 S 7/1995 Stamberg et al.
D360,538 S 7/1995 Skalka
D360,995 S 8/1995 Pedersen
D362,348 S * 9/1995 Sacchi Lodispoto ..... D6/336
D365,937 S 1/1996 Skalka
5,522,182 A 6/1996 Rogers
D373,257 S 9/1996 Hutton
D379,876 S 6/1997 Wood
5,653,507 A 8/1997 Moore
D393,965 S 5/1998 Sandy
D394,561 S 5/1998 Oltmans
D411,061 S 6/1999 Klein
D415,360 S 10/1999 Lewis
D418,338 S 1/2000 Livieratos
D419,008 S 1/2000 Livieratos
D425,319 S 5/2000 Kemnitzer
D425,337 S 5/2000 Hellwig et al.
6,217,120 B1 4/2001 Pugliese
6,241,317 B1 6/2001 Wu
6,263,629 B1 * 7/2001 Brown, Jr. ..... 52/309.16
6,279,997 B1 8/2001 Moore et al.
6,367,874 B2 4/2002 Casini
6,367,880 B1 4/2002 Niederman et al.
6,393,776 B1 * 5/2002 Waller et al. ..... 52/169.6
6,517,279 B1 * 2/2003 Camomilla et al. ..... 404/6
6,887,010 B2 * 5/2005 Mayer Rodis ..... 404/6
7,104,720 B2 * 9/2006 Humphries et al. ..... 404/6
2003/0223811 A1 * 12/2003 Vandenbossche ..... 404/6
2004/0076468 A1 * 4/2004 McKay et al. ..... 404/6
2004/0123541 A1 * 7/2004 Jewett ..... 52/506.01
2005/0272329 A1 * 12/2005 Tueshaus et al. ..... 442/18

* cited by examiner

SECURITY BENCH

This application claims priority from a Provisional Application Ser. No. 60/524,711, filed Nov. 24, 2003, and from a Provisional Application Ser. No. 60/567,572, filed May 4, 2004, both hereby incorporated by reference in their entireties.

FIELD OF THE INVENTION

The present invention relates to barricades, closures, and furniture items, and, more particularly, to furniture items that provide both furniture/seating functionality and defensive barricade functionality.

BACKGROUND OF THE INVENTION

Squat, wall-like, concrete traffic barricades have long been used for temporarily dividing road lanes and cordoning off construction areas. After the bombing of the Alfred P. Murrah Federal Building in Oklahoma City, and even more so after the events of Sep. 11, 2001; however, such barriers were put in place around most key government buildings, e.g., the White House area and federal courthouses. This was done to prevent vehicles from being easily parked in close proximity to buildings for nefarious purposes, except at designated areas where illegal activity could be identified and prevented, e.g., guarded entryways and loading docks.

While conventional concrete barricades work fairly well, they are completely functional in nature and, as such, quite unattractive and unpleasing from an aesthetic sense. In fact, put frankly, the prolific use of concrete barricades around government buildings (mostly located in heavily traveled downtown areas) has resulted in something of an urban blight. For example, while the typical federal courthouse might be architecturally attractive or at least inoffensive, deploying an array or line of standard concrete barriers around such buildings results in the unpleasant appearance of a construction area or "war zone."

Because of this, it became apparent that there was a need for "hardened" street furniture and "transparent defenses" meeting certain criteria including: simplicity; attractiveness; capability for use as a perimeter barrier around secure locations; ability for appearance modification; ability for mass production using a number of materials; the possibility of different component dimensions; rigidity; and the ability to convert the materials to meet varying security requirements.

Accordingly, a primary object of the present invention is to provide a security bench with the above-noted qualities that functions as an improved barrier against vehicular access and explosive force, and that acts as a functional and comfortable street bench.

SUMMARY OF THE INVENTION

A security bench according to the present invention is designed as an attractive single piece of site furniture that inherently acts as a solid mass giving a degree of protection from vehicular traffic, and that acts as a "catch basin" to capture explosive debris. Intended to replace "Jersey barriers" and other unsightly defenses, the security bench may be used singly or in multiple units to direct traffic flow, act as a perimeter barrier, and/or to limit entryway access. The security bench also functions as an attractive bench for public seating. The configuration and dimensions may be altered to meet civilian requirements for decor and security, and to meet requirements for highly secure government and military installations, while maintaining the basis of original design and the appearance of a conventional street bench.

Problems of achieving combined design requirements and enhanced structural integrity have been addressed by this new concept. The disclosed design may be altered to match local architecture and/or to enhance a particular setting while keeping the integral structure of the piece intact.

A preferred embodiment of the security bench comprises an I-shaped support base, a high-strength framed screen securely attached to and overlapping the top of the support base, and a seating surface attached to the top of the framed screen. The base, preferably made of granite, concrete, or the like, is relatively massive, providing resistance to vehicular and explosive force. The frame portion of the framed screen, preferably made from structural steel, reinforces the structural integrity of the base, while the screen acts to repel or absorb explosive force or debris. Further, a backrest of various materials and designs may be added at the time of assembly, or later, utilizing a number of different fastening methods and materials, all of which would be made integral to the passive nature and defensive posture of the bench itself.

While maintaining the basic design and securing principles of the recessed support as described in co-pending patent application Ser. No. 10/444,362, filed May 23, 2003, the present configuration may be altered to meet many of the design needs and the varying requirements of architects, designers, and city planners and the utilization thereof as an innocuous defensive mechanism.

The present invention was first made in granite as an original idea that coincidentally met some of the Security Design Coalition (SDC) requirements for site furnishings that "provide security while maintaining both functional and aesthetic virtues." The present invention offers a simplified security bench design that may be duplicated and modified in concrete, composites, aggregates, or other natural or manmade materials suitable for achieving the desired mass, configuration, and function.

The security bench design of the present invention, with or without a backrest, is capable of being altered while maintaining the integrity of its defensive application. Further, the security bench may be placed in adjacent positions with or without connection to one another with little design modification or enhancement. The bench may be dimensionally altered to accommodate different intended uses while maintaining the basic appearance of street furniture simply fixed to the ground by rods or other fixtures for permanent installation or not depending on intended use and function.

According to alternative embodiments, the security street bench support base may have a hollow interior, for filling with ballast at the installation location. In this manner, much of the weight/mass of the bench can be eliminated for manufacturing and shipping, and then added to the bench on site using common, inexpensive/free materials such as rock, concrete chunks, sand, liquid, or debris. One version of such a support base comprises a plurality of hinged, interconnected panels (mesh or solid panels) that can be disassembled or folded for shipping, and then deployed on site for forming the support base. Another version utilizes a hollow polymer or metal shell, while yet another version utilizes a collapsible, flexible material for the base.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE PREFERRED EMBODIMENTS

Figure 1:
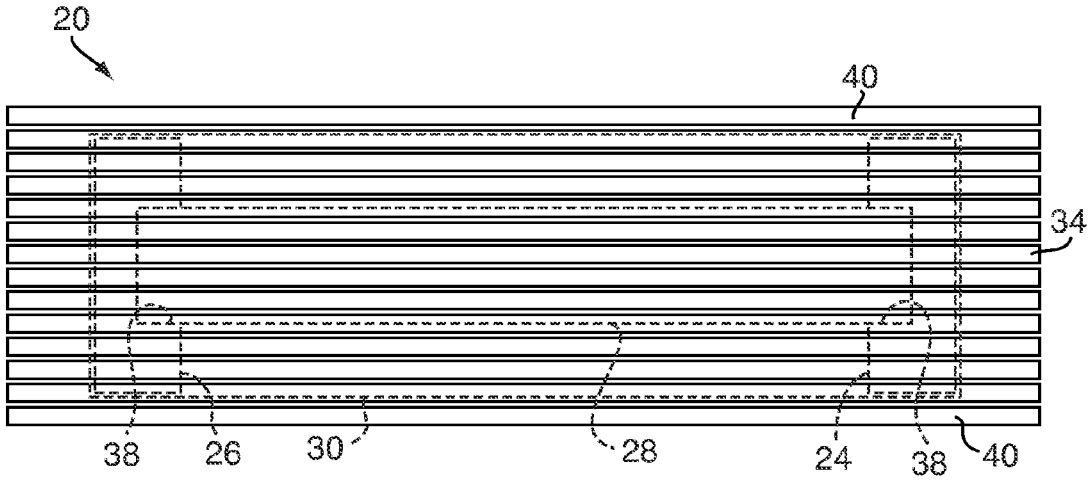
FIG. 1 is a top plan view of a first embodiment of a security street bench design according to the present invention.
Figure 2:
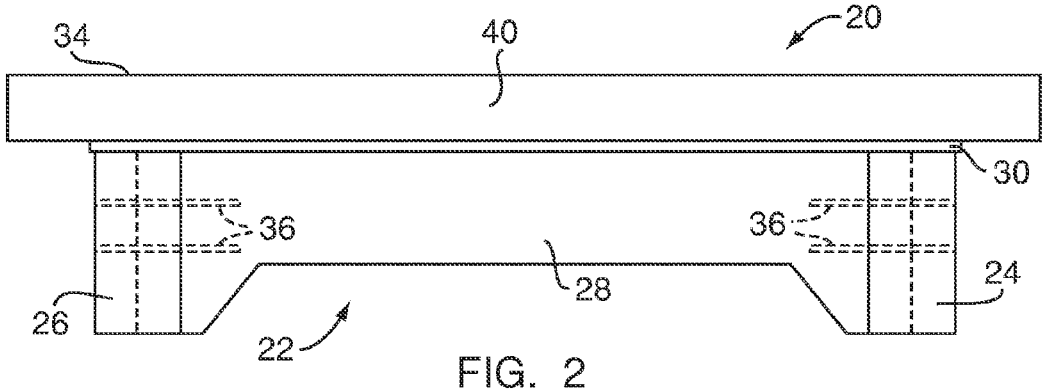
FIG. 2 is a front elevation view thereof.
Figure 3:
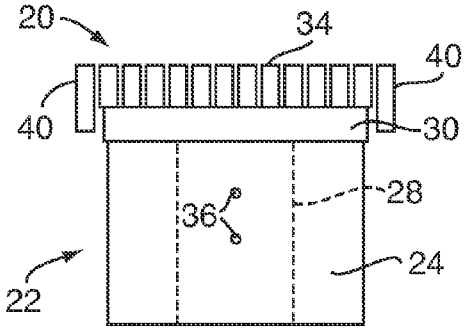
FIG. 3 is a side elevation view thereof.

With reference to FIGS. 1-6, a first embodiment of a security bench 20 comprises: a high-mass, generally I-shaped base 22 having two end supports 24, 26 and a transverse section 28; a structural steel frame 30; a "security screen" 32 (a panel of wire mesh or screening); and a seating surface 34. As best shown in FIG. 2, the end supports 24, 26 are attached to the transverse section 28 by a plurality of bolts 36. The bolts 36 extend through the end supports 24, 26 and into the transverse section 28 to a depth consistent with the demands of structural integrity and the desired capability of the piece to act as shield or barricade. The security screen 32, placed under the seating surface 34 and not obvious to public view, is attached integrally to the steel frame 30, which is in turn attached to the end supports 24, 26 by means of standard high-strength bolts or other fixtures (not shown). Finally, the seating surface 34 is attached to the frame 30 and/or base 22 using standard connectors.

The base 22, the frame 30, the screen 32, and the seating surface 34, affixed together, collectively form a "hardened" piece of street furniture. In particular, the bench serves as a barrier to traffic and explosive debris and acts to limit the dissemination of that debris by deflecting, capturing, and containing it within the underside of the bench 20. The security bench 20 can be used individually or multiply, and serves both form and function, providing conventional, attractive seating and "transparent security", namely, a passive defense mechanism capable of adding protection and shielding for people and buildings.

The various components of the security bench 20 may be fabricated from stone, concrete, metal, composite, aggregates, other natural or manmade materials, or other materials meeting the requirements of a unified mass whose purpose is defensive in nature. In particular, any natural or manmade materials may be used, provided they are capable of being shaped, cut, molded, or otherwise fabricated, and either singularly or collectively meet specifications appropriate to the primary function of defense and secondarily, aesthetics. Seating may or may not be considered inherent to the defensive nature of the bench depending on design and construction.

The generally block-shaped end supports 24, 26 are used in pairs to form naturally supporting end members to which the other components are securely attached. For mating with the transverse section 28, each end support 24, 26 may include a slot 38 dimensioned to accommodate the end of the transverse section (see FIG. 6). The supports may be constructed of natural or manmade material meeting required specifications to create a ridged configuration with or without internal fiber, wire, rod, mesh, or other means of reinforcement. The end supports may be prefabricated enabling reproduction at one or more de-centralized locations. The design may be modified to yield multiple designs while maintaining structural integrity through the possible use of one or more means of reinforcement. Using alternate materials that are capable of being preformed (such as concrete), the ends and transverse section may be of a rigid configuration inherent to each other with or without internal fiber, wire, rod mesh or other reinforcement means throughout the singular base.

Figure 6:
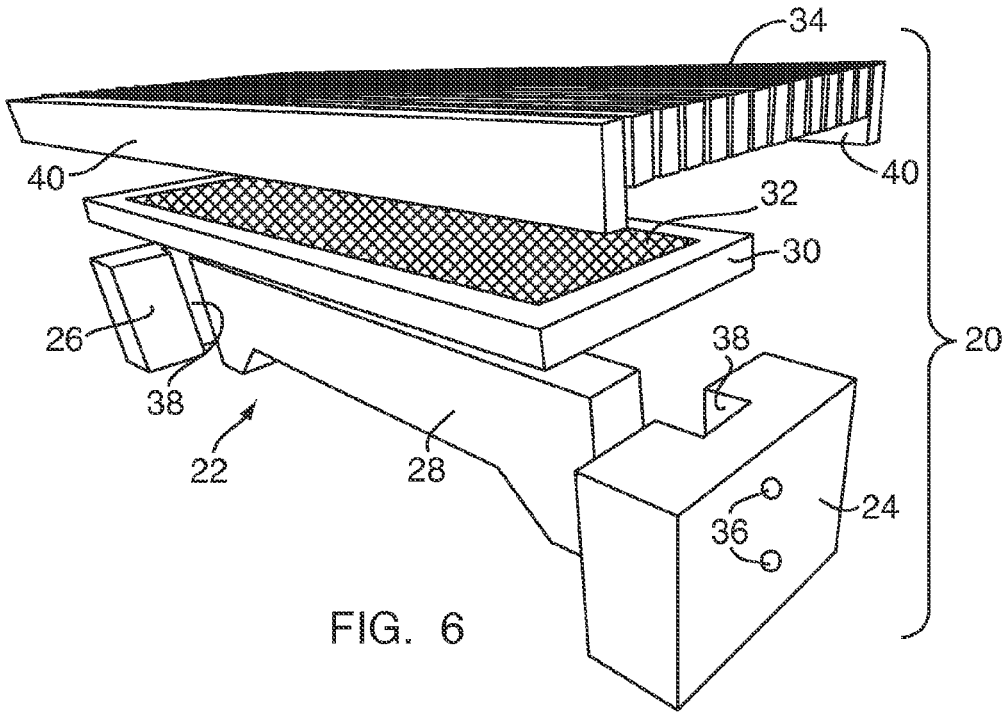
FIG. 6 is a perspective exploded view thereof.
Figure 6B:
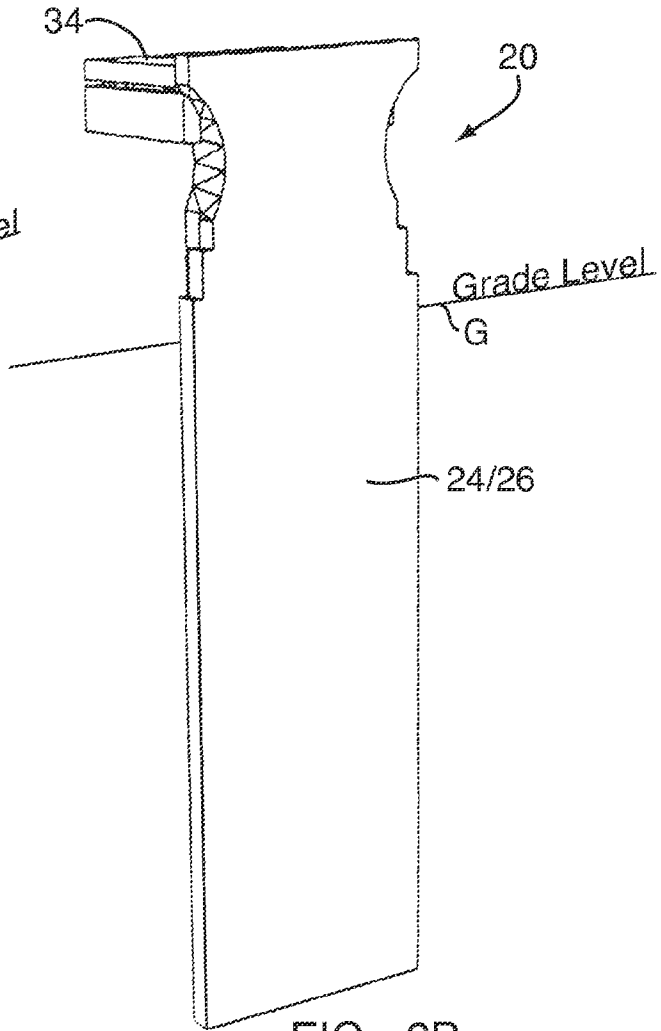
FIGS. 6A and 6B illustrates right and left perspective views, respectively, of a security bench in accordance with another embodiment of the present invention.
Figure 6A:
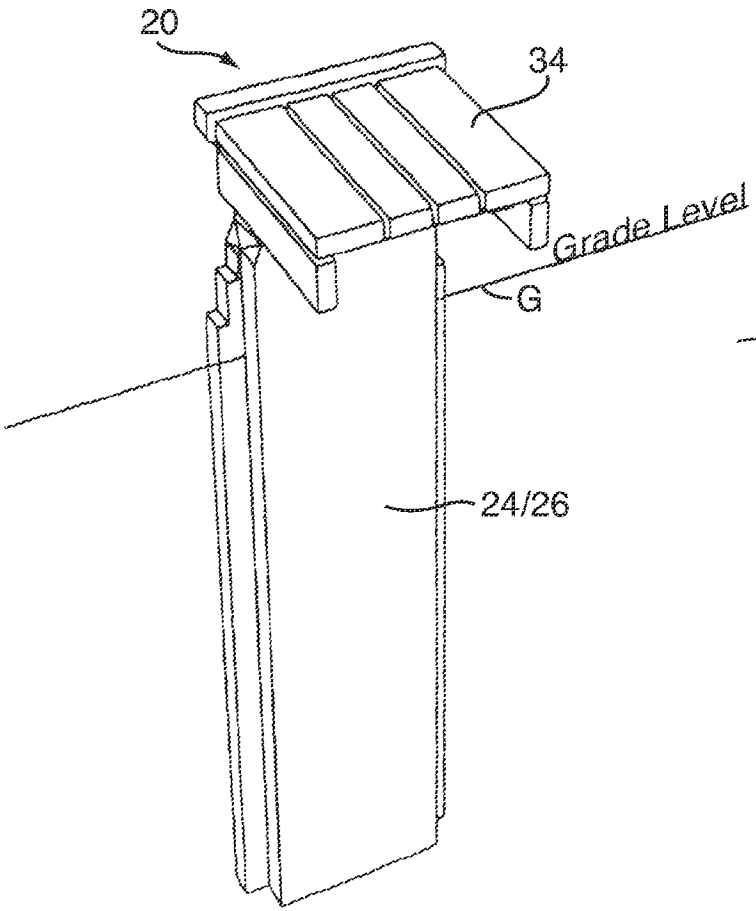
Figure 7:
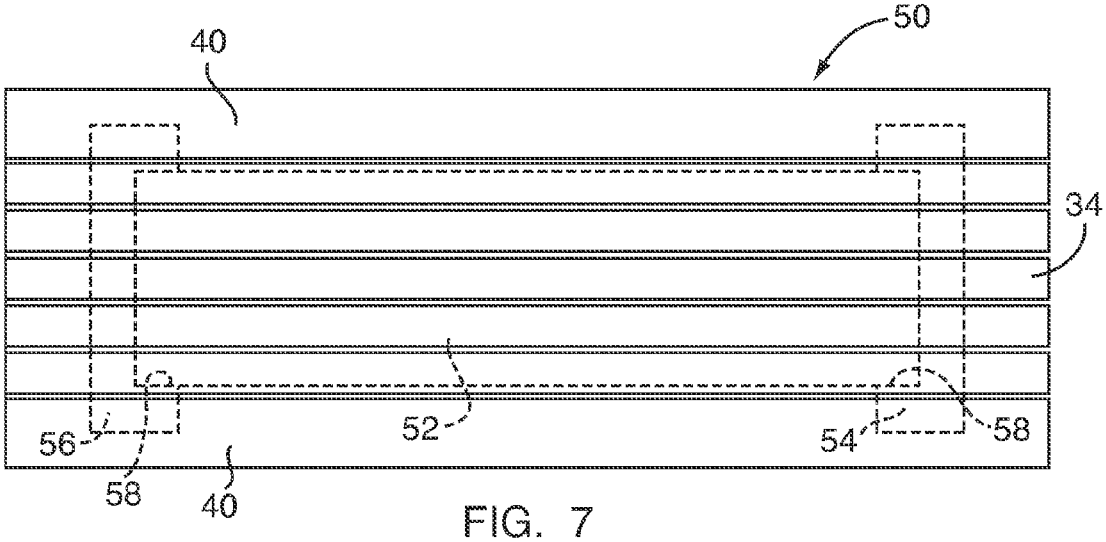
FIG. 7 is a top plan view of a second embodiment of the security street bench according to the present invention.
Figure 8:
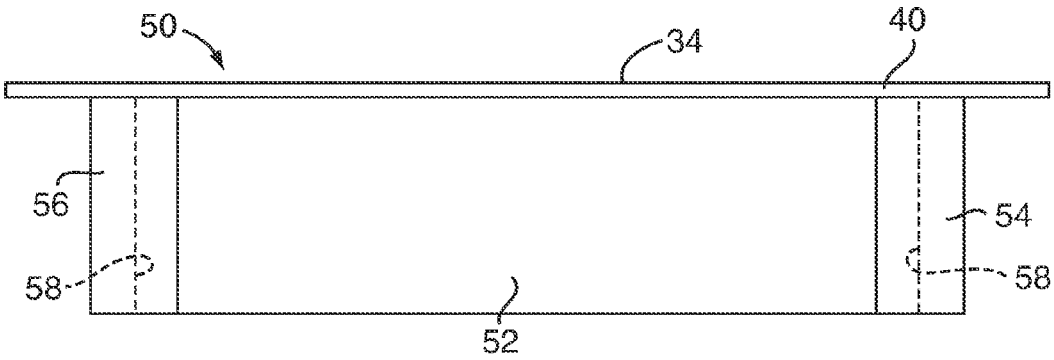
FIG. 8 is a front elevation view thereof.
Figure 9:
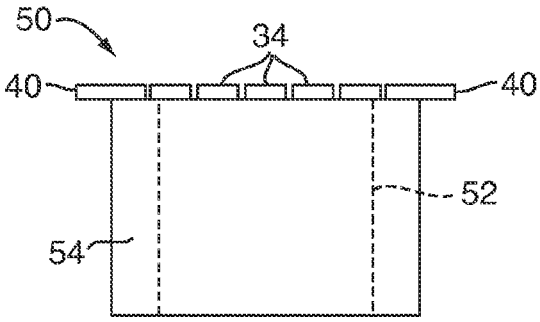
FIG. 9 is a side elevation view thereof.
Figure 10:
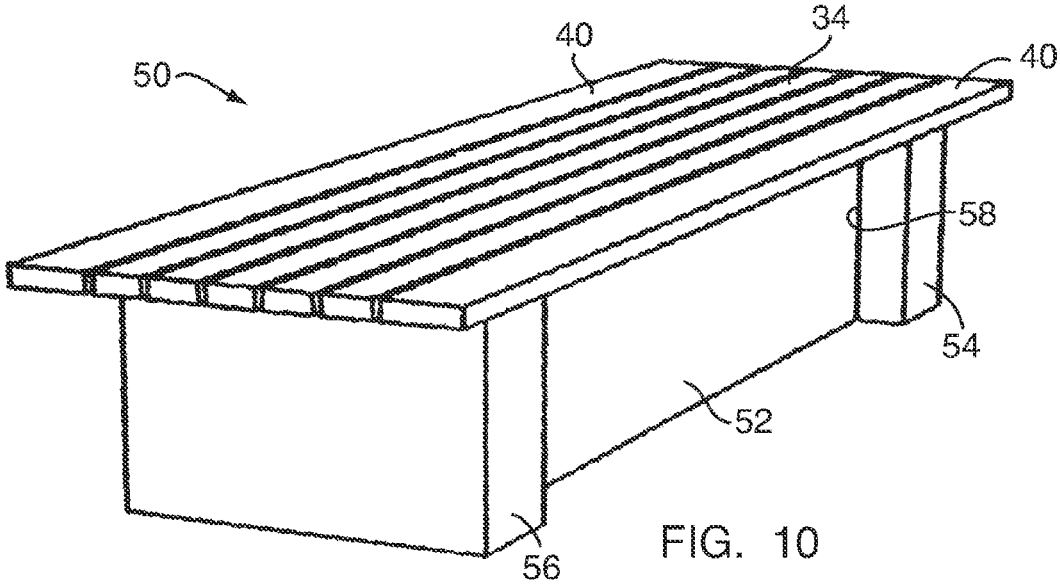
FIG. 10 is a perspective view thereof.

The end supports 24/26 may or may not be fixed to the ground by steel rods or other devices depending on functional requirements. FIGS. 6A and 6B illustrate right and left perspective views of an alternative embodiment of the present invention in this regard, in which the end supports 24/26 are lengthened so as to extend a predetermined distance below ground level G. It will be readily appreciated that by extending the end supports 24/26 below ground level G, the security bench 20 will enjoy a significantly increased structural stability. It will also be readily appreciated that in addition to the end supports 24/26 extending below ground level G, the present invention also contemplates fabricating the transverse section 28 so that it too extends below ground level G, thereby further strengthening the structural stability of the security bench 20.

Although specifically discussed in conjunction with the embodiments of FIGS. 1-6B, the concept of extending various structural elements of the security bench 20 below ground level G is equally applicable to all embodiments hereinafter discussed.

Figure 11:
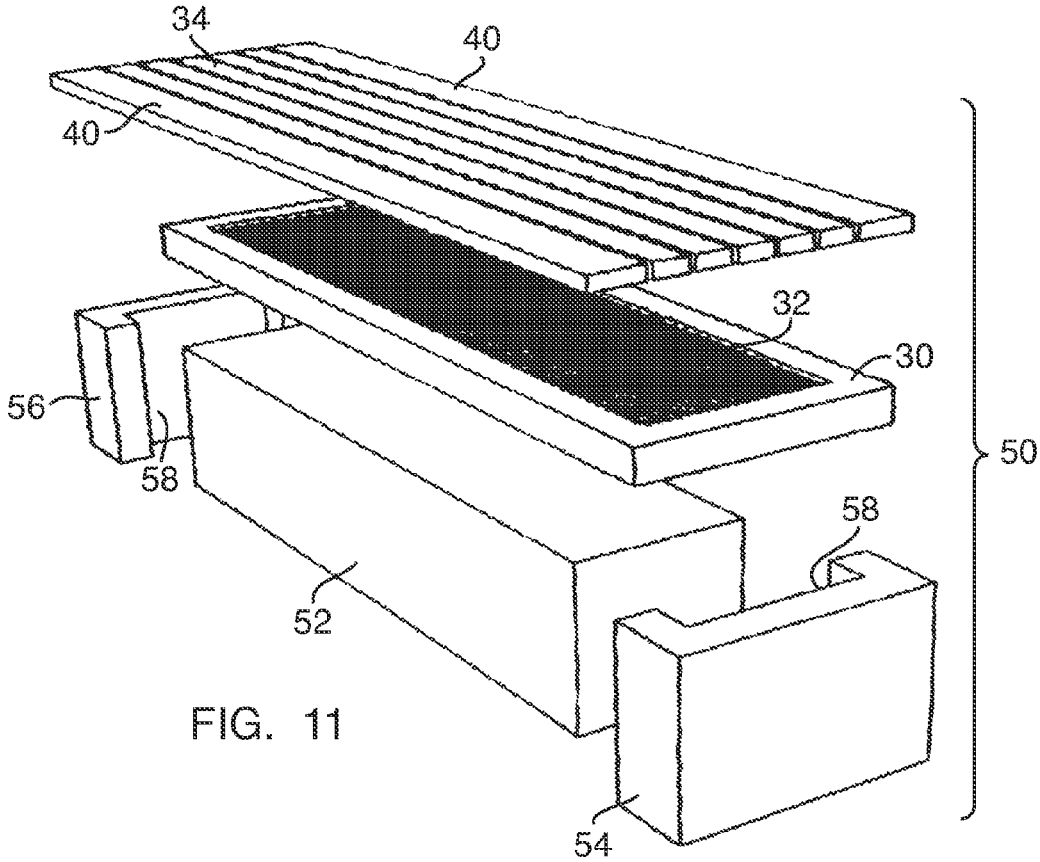
FIG. 11 is a perspective exploded view thereof.
Figure 12:
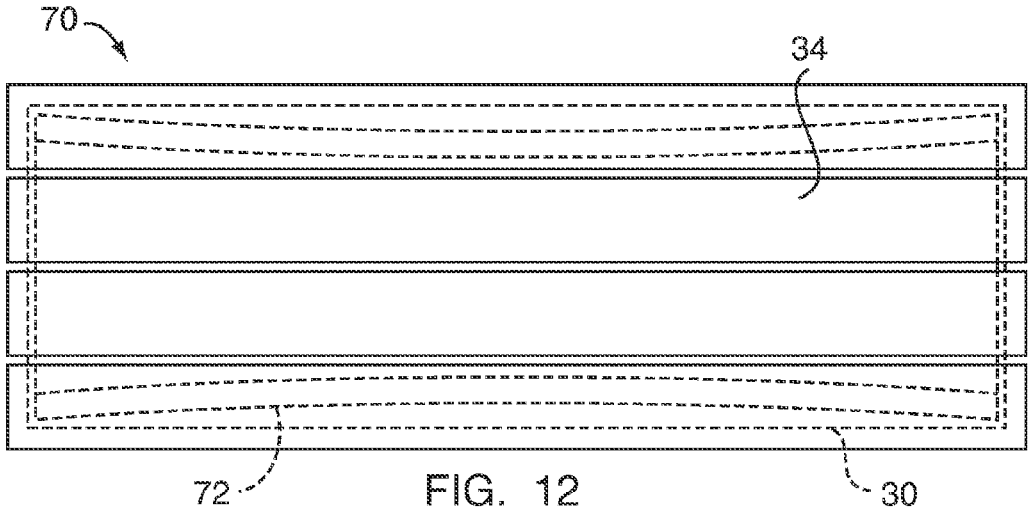
FIG. 12 is a top plan view of an alternative embodiment of the security street bench according to the present invention.
Figure 13:
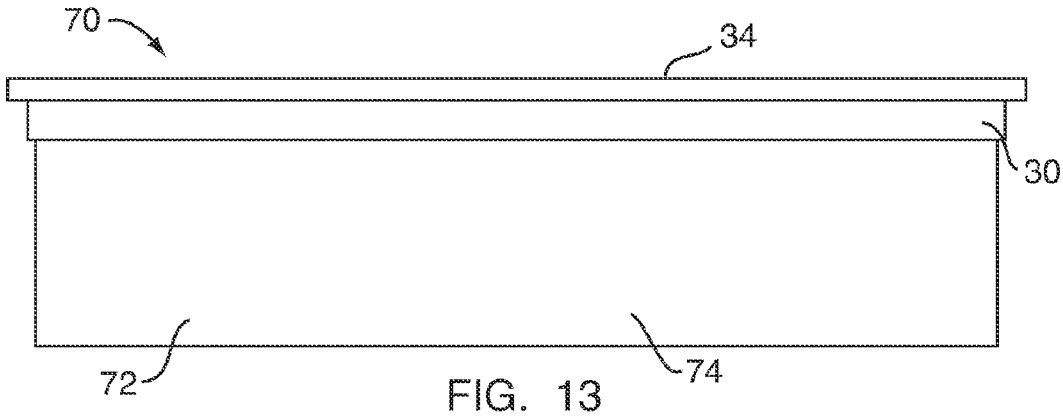
FIG. 13 is a front elevation view thereof.
Figure 14:
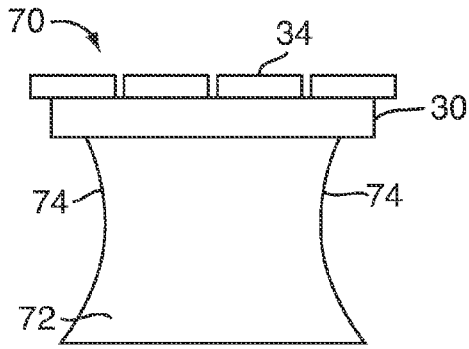
FIG. 14 is a side elevation view thereof.
Figure 15:
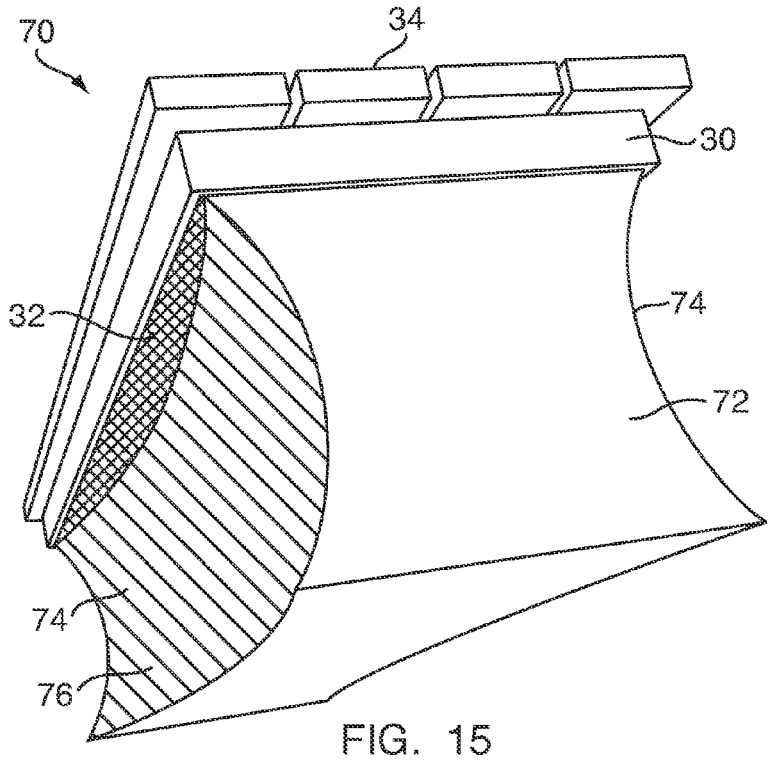
FIG. 15 is a perspective view thereof.
Figure 16:
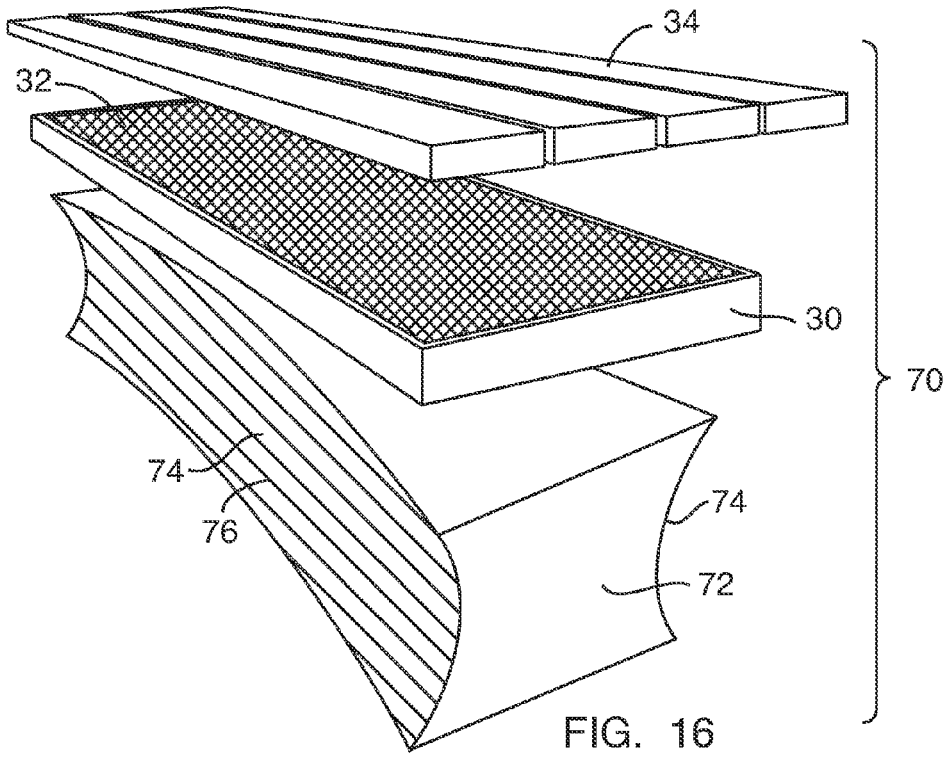
FIG. 16 is a perspective exploded view thereof.

Returning to the embodiment discussed in connection with FIGS. 1-6B, the transverse section 28 is a key element of possible protection, deflection, and/or absorption of debris. It provides an integral median between the end supports 24, 26 and the supported surface(s) 30, 34. The transverse section 28 may be relatively thin for normal venues (see FIG. 6) or thicker for areas where a higher degree of protection and security is required (see FIG. 11).

In both cases, the appearance in profile is similar. The transverse section 28 may be a separate piece as depicted in FIGS. 1-6 (made of granite, concrete or other aggregate, composite, or manmade material) attached to the end supports 24, 26, or the transverse section and end supports may be integrally formed together, which together may or may not be reinforced with internal fiber, wire, rod, mesh, or other material. The joint involving the end pieces 24, 26 and the transverse mass 28 (i.e., including the end support slots 38) may be adjusted in dimension to accommodate a variety of thicknesses of the transverse mass 28 designed and manufactured in accordance with the severity of the desired deflection or repellent capability.

The generally rectangular frame 30 aids in maintaining the integrity of the support ends and transverse section as a whole. The frame 30 acts to further secure the ends 24, 26 to the transverse piece 28, and provides a place for supporting and securely attaching the seating surface 34. The welded steel frame 30 is attached to the upright supports by bolts or other fasteners as a modified embodiment of U.S. patent application Ser. No. 10/444,362, dated May 23, 2003, hereby incorporated by reference in its entirety. For example, the frame 30 may be attached directly to the supporting granite members 24, 26, 28 by bolts, screws, or other suitable anchoring means for securing the supporting members 24, 26 and transverse section 28 together as a single mass unit.

The frame 30 is made of welded structural angle iron (steel) or another substantial material. In either case, the frame material should meet the requirements for physical integrity as a unified piece fixed to the end supports and also affixed to the surface(s) to be supported, e.g., the seating surface 34. The longitudinal sides of the frame 30 may be covered by decorative side rails 40 attached to and extending down from the seating surface 34 (see FIGS. 3 and 5), i.e., the rails 40 may comprise a longitudinal edge portion of the seating surface that extends further down than the remainder of the seating surface, to cover the frame 30.

The function of the frame 30 is four fold: it provides a secondary means of securing the end supports to the transverse section; it provides a base for which the seating surface is attached and rests; it provides a frame for which the security screen is integrally attached; and it provides a surface to which a side rail or other amenity may be attached.

The security screen 32 is integrally attached within the frame 30 and lies under the seating surface, hidden from obvious view. The screen 32 may be steel screening, mesh, or another material capable of repelling, deflecting, and/or absorbing debris. The screen enhances the defensive nature of the bench 20 by its ability to repel, deflect, and/or absorb potential explosive debris.

Figure 17:
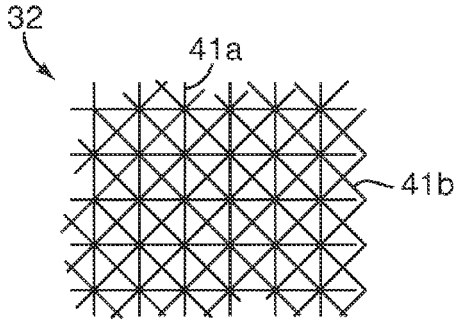
FIG. 17 is a detail view of a multi-layer mesh security screen.

The security screen 32 may be fabricated of a single layer, or a plurality of layer(s), each of the layer(s) being configured as intersecting rows and columns of hardened materials, such as, but not limited to, metal, ceramic, or polymer materials. It will be readily appreciated that the rows and columns forming the mesh of the screen 32 may be at any angular orientation with respect to one another without departing from the broader aspects of the present invention. Moreover, in accordance with a preferred embodiment of the present invention, should stacked (superimposed), multiple layers 41*a*, 41*b* be employed to form the screen 32 (see FIG. 17), it will also be readily appreciated that the rows and columns of differing layers do not directly coincide with each other. That is, the openings in the screen 32 formed by the rows and columns of a given layer 41*a* are themselves bisected in part by the rows and columns of those layer(s) 41*b* positioned above and/or below that layer 41*a*. Alternatively, the screen 32 may comprise a layer (either by itself or as part of two or more stacked layers) made from a plurality of materials interwoven or interleaved with one another. For example, the screen 32 could comprise a first mesh made from one material, and a second mesh made from another material and interwoven with the first mesh, either at an angle with respect to the first layer or not.

An important aspect of the present invention is therefore to provide a security mesh, in the form of the screen 32, that permits water drainage and the like while also impeding the migration of explosive force and debris.

The seating surface 34 is attached to the frame 30 from beneath by way of screws extending through the frame 30 and into the seating surface(s) 34, e.g., as a modified embodiment described in the aforementioned '362 application, or by way of another, standard attachment means. The seating surface may be fabricated from any materials either natural or manmade, and serves two purposes: a surface for seating of any design and material; and, depending on the materials selected for the seating and the arrangement of those materials, the seating surface may contribute to the defensive nature of the piece either by repelling, deflecting, and/or absorbing possible explosive debris.

As should be appreciated, the integrity of the assembled bench 20 is fixed since the transverse mass 28 is securely attached to the ends 24, 26 by the joints 38 themselves and/or by the bolts 36 extending through the ends and into the transverse mass, with the welded steel frame 30 likewise attached.

As such, theft is curtailed by the weight and integrity of construction. While the end fasteners are apparent to view, those and other fasteners may be permanently fixed and virtually impossible to remove without destroying the bench 20. However, despite this, shipping problems have been addressed by allowing the bench 20 to be shipped as separate pieces with simplified assembly at the point of installation.

Figure 4:
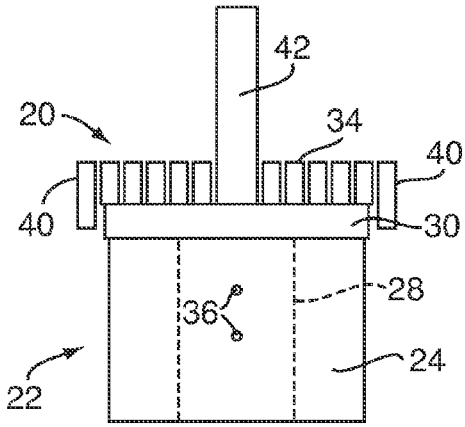
FIG. 4 is a side elevation view thereof with backrest.
Figure 5:
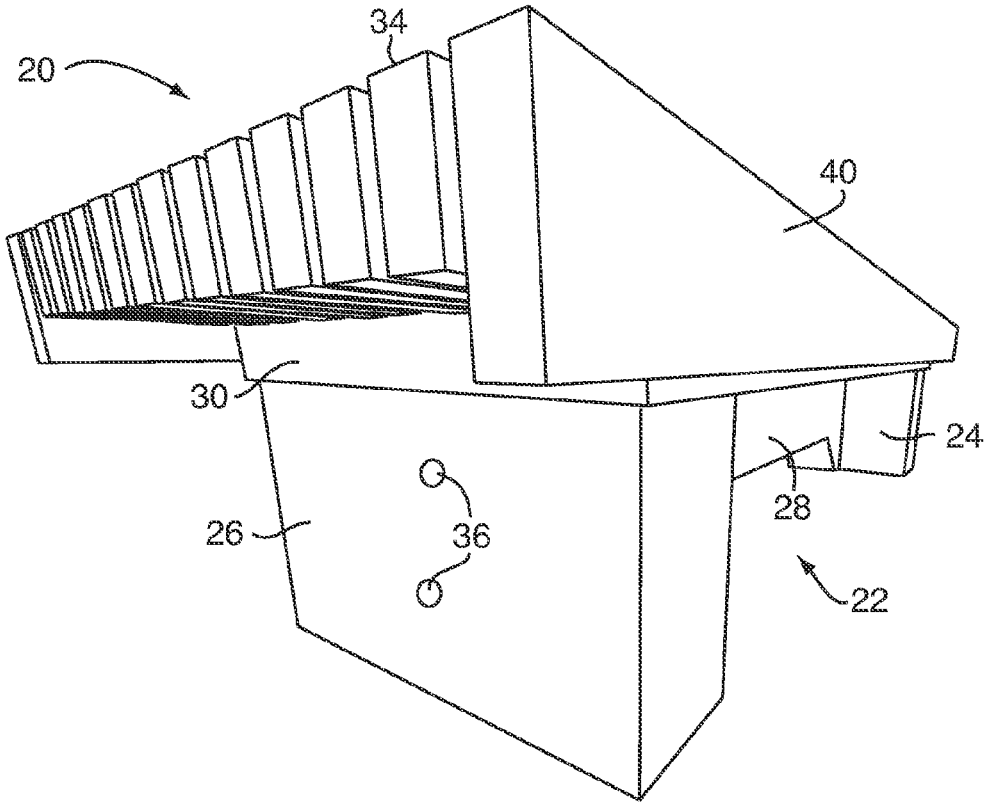
FIG. 5 is a perspective view thereof.

As shown in FIG. 4, the bench 20 may include an optional backrest 42. In this view, the bench is for seating on both sides of the backrest. The backrest 42 may or may not be a vertical extension of the transverse section 28. It may be of any natural or manmade material according to any design that enhances the function and/or appearance of the bench 20. Having a backrest of structural material raises the height of the defensive posture of the bench.

The bench 20 may include further security features such as a covering or coating with paint, mesh, Kevlar®, rubberized or other material, to act as an absorbent or repellent of explosive debris. In particular, the base 22 and screen 32 may be coated or covered with paint, fabric, wire, absorbent material (such as rubber), or another covering materials as an aesthetic enhancement and/or to improve the defensive nature or the piece by aiding in the deflection, repellent, and/or capturing of debris.

FIGS. 7-11 show a second embodiment of the present invention. Here, a security street bench 50 with a greater degree of "hardening" is generally similar to the bench 20, but includes a wider and more massive transverse portion 52. As such, instead of having a relatively narrow, slightly arched transverse 28, the transverse portion 52 of the bench 50 is significantly wider, forming a large, generally rectangular solid with generally square ends. To accommodate this increased width, the end supports 54, 56 have wider vertical slots 58. This design, with the larger, more substantial transverse portion 52, would provide a greater degree of defense against explosive debris and other considerations such as limiting vehicle access.

The above-noted designs may be modified to change the manner or degree in which possible debris or explosive force is focused, deflected, or repelled. For example, an additional embodiment of the present invention is shown in FIGS. 12-16. There, a bench 70 is generally similar to the ones described above, but the bench base 72 is constructed of reinforced concrete molded to a bottom-weighted shape, with concave side surfaces 74, and without separate end supports. This shape is designed to aid in the repelling, deflection, and/or containment of explosive debris. The base 72 (as shown, or provided in any of a myriad of other possible shapes) may be coated and or covered with a rubberized fabric, mesh, or other material 76 that would deflect/absorb shock and keep the base from fracturing in the event of a collision or blast. The outer covering would be painted or otherwise finished to compliment the surrounding environment.

The benches 20, 50, 70 may be manufactured from granite or other natural materials as follows: (1) cut and drill stone per specification; (2) fabricate angle iron or other structural material for the frame 30; (3) fabricate security screen 32 and fix to frame 30; (4) fabricate seating 34 with or without a backrest and attach to frame 30; and (5) assemble all parts with bolts, rods, or other devices consistent with the intended function and placement.

For concrete or other composites, aggregates, or other materials whether natural or manmade, with or without reinforcement, the following manufacturing process may be used: (1) pour or otherwise manufacture base unit either as a whole or in parts; (2) fabricate angle iron or other structural material for the frame 30; (3) fabricate security screen 32 and fix to frame 30; (4) fabricate seating 34 with or without a backrest and attach to frame 30; and (5) assemble parts with bolts, rods, or other devices consistent with the intended function and placement.

As used herein, the term "high-mass" refers to a component having security-appropriate mass/weight characteristics such as, but not limited to: an average of at least 600 pounds (273 kg) per linear foot. This value has been found in traffic barriers to provide a sufficient degree of resistance against movement by errant vehicles.

Although the security bench of the present invention has been illustrated in FIGS. 1-17 as having a generally elongate base and other components, one of ordinary skill in the art will appreciate the components could be made shorter, e.g., for use as a short bench or chair, without departing from the spirit and scope of the invention. Also, although the bench has been shown as being rectangular, it could instead be square, for providing a four-sided seating surface. Indeed, the present invention equally contemplates that the configuration of the bench 20 could also be triangular, multi-sided, ovoid, round, or any other geometric shape without departing from the broader aspects of the present invention, so as to mesh in harmony with planners' ideas and/or specifications.

Figure 18:
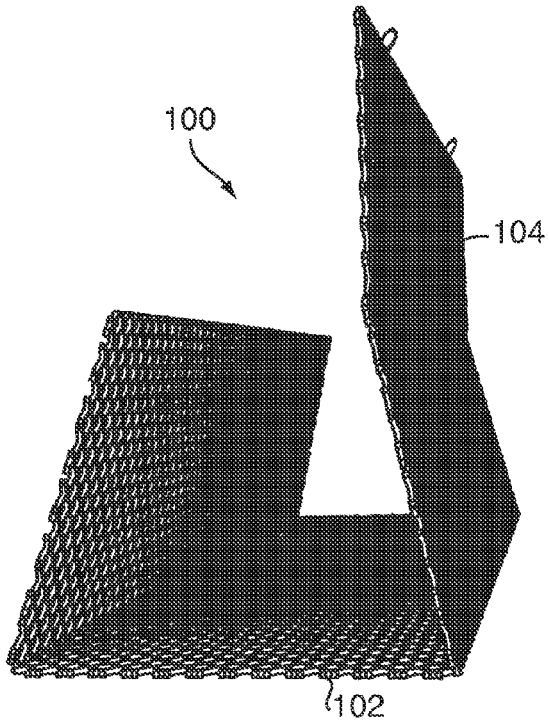
FIG. 18 is a partial perspective view of an alternative embodiment of a base portion of the security street bench.
Figure 19:
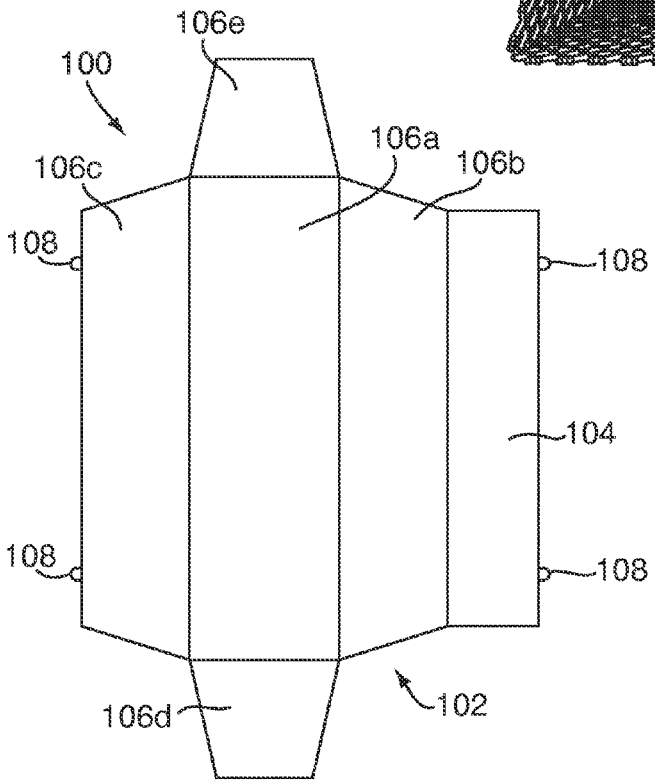
FIG. 19 is a top plan view of the base portion shown in FIG. 18.
Figure 20:
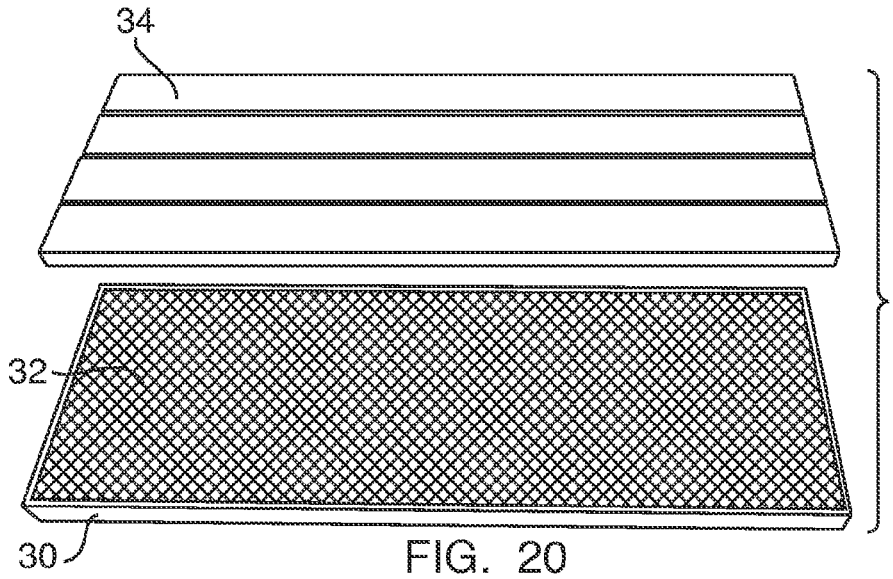
FIG. 20 is a perspective view a security frame, security screen, and seating surface portion of the security street bench.

Turning now to FIGS. 18-20, in accordance with yet another embodiment, the present invention encompasses a security bench that is defined by a screen assembly, or similar enclosure, forming the desired shape of the bench base. As shown in FIG. 18, a screen panel base 100 includes a plurality of articulated panels 102, including a hinged top panel 104 (the end panels of the base 100 are not shown, but will be described in more detail later). Once manipulated into their final configuration, but prior to the top panel 104 being secured, the base 100 may be filled with stone, sand, rock, brick, concrete, miscellaneous debris, or other readily available materials, either natural or manmade, to provide the necessary ballast to deter theft and vandalism, as well as to provide a 'high-mass' impediment to explosive debris or forces.

The top panel 104 is fixed to the remainder of the panels 102 by any appropriate means. Once the top panel 104 is secured in place, the base 100 then functions in a defensive manner while the top area is for public seating. The top, if hinged or fixed appropriately, may be moved from the horizontal position of a bench top to a raised or vertical position, as shown in FIG. 18, thereby adding height to the defensive nature. The seating surface may be similarly configured for being raised to a vertical position. In either case, positioning means would be provided (e.g., stops, catches, guide bars) for keeping the element (top or seating surface) in the raised position.

Although the panels 102 shown in FIG. 18 illustrate a base formed from a ballistic resistant screen material, it will be readily appreciated that solid, imperforate panels (e.g., metal or polymer panels) could be used instead.

FIG. 19 shows the base 100 in a "knocked-down" condition ready for final assembly in the field. Here, the various base panels 102 are shown as comprising a bottom panel 106*a*, side panels 106*b*, 106*c*, end panels 106*d*, 106*e*, and the top panel 104. The panels 102 are made of a ballistic resistant screen or other material, and are hinged together via standard removable pins, hinges, or the like (not shown). Hasps, eyes, or other fixtures 108 are provided for securing the top panel 104 and base 100 in their finally assembled state, via, e.g., locks or other secure connectors. For assembly, the panels 106*a*-106*e* are folded together to form the base 100, in a similar manner as shown in FIG. 18, the interior is filled with ballast, and the top panel 104 is secured in place.

The base 100 may be used as a stand alone security bench, but, as shown in FIG. 20, it will typically act as the base support for a seating surface 34, frame 30, and security screen 32, as described above in relation to the security bench 20. In such a case, the seating surface 34, frame 30, and security screen 32 would be securely affixed to the base 100 using standard connection means (hinges, bolts, etc.). End pieces 24, 26 may also be used (i.e., the base 100 would act similarly to the transverse section 28) if additional weight or stability is required.

To manufacture the base 100, ballistic resistant screening or other structurally applicable material is cut, bent, molded, and welded or otherwise fabricated to a particular design forming a fully enclosed cage with one or more sides hinged to allow the "cage" to be filled with materials suitable for design and/or security requirements. The hinged top may be fit with a hasp and padlock or other means of making the unit secure for storage purposes.

Figure 21:
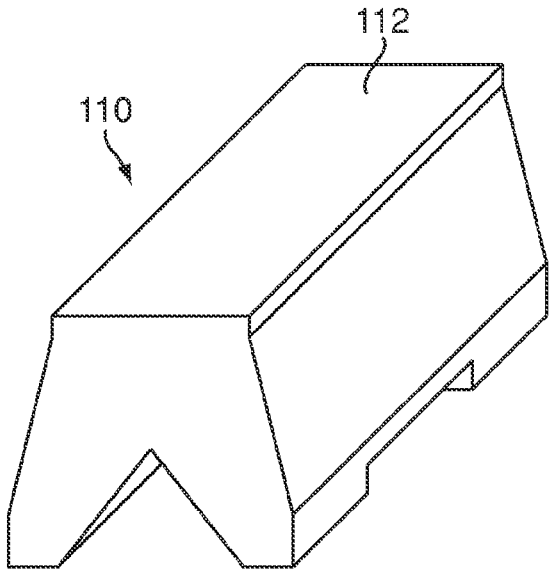
FIG. 21 is a perspective view of another alternative embodiment of the base portion.

As shown in FIG. 21, the idea of a ballast-filled security base is extended to a base 110 which may be constructed of hard or soft plastic/polymer or other substance such as sheet metal, and filled with water or other liquid, sand or other natural or made materials. The molded plastic (or other moldable or malleable material) bench base 110 would be designed to conform, contrast, or accent the surrounding architectural elements and to meet environment and/or security requirements. The base 110 may have a hinged top 112 (for accessing the interior to fill the bench base with ballast), and would be configured to support a security frame 30 and screen 32, as well as a seating surface 34.

For manufacturing, the base 110 may be molded of plastic/polymer, polycarbonate resin, constructed of fiberglass, Teflon® or other materials or combinations of materials to a form consistent with engineering, security, and/or architectural requirements. A preferred material would be a fiberglass and Teflon® composite.

Figure 22:
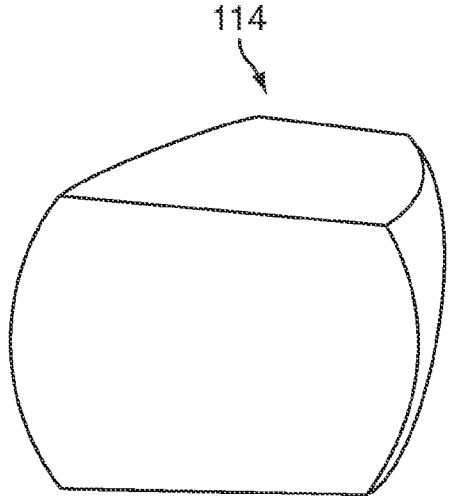
FIG. 22 is a perspective view of yet another alternative embodiment of the base portion.

Turning to FIG. 22, according to an additional embodiment of the present invention, a bench base 114 may be made of a sturdy flexible material (e.g., a rubber-like material, or fabric), like a balloon or beanbag, or a mix of solid/non-flexible and flexible materials, e.g., solid top and bottom panels and flexible sidewalls. (A preferred material would be a nylon, Teflon® and rubberized composite.) In this case, the desired shape is then developed as the form is filled. The bench/seating top is fixed to the base by any appropriate means. As in the above-described embodiments, the base 114 then becomes the defense mechanism while the top area is for public seating or may be raised from the horizontal position of a bench top to a raised or vertical position thereby adding height to the defensive nature. The seating is then fixed in a raised position by appropriate means.

The advantages of the embodiments set forth in FIGS. 18-22 is the ability for greater flexibility of design as well as reducing weight, and in some cases the ability to ship the security bench "knocked down" or collapsed, saving the costs of construction, materials, time, shipping, and handling. In addition, for security purposes, any locally available materials may be used to fill the forms. The solid(s) or liquid nature of the material fill would further absorb shock and impact. Further, the benches may be used as secure storage lockers on site or for shipping purposes, or as shipping containers for solids, liquids, or gasses, or as floatation devices (when filled with, e.g., plastic foam pellets).

From a security standpoint, with the above designs, the problem of continuous length would be addressed as virtually any length may be made. A continuous barrier of various configurations with public seating is then possible. Additionally, as presented, or with little design modification, the seating could quickly be stacked one upon another forming a higher barrier, and/or the seating surface could be stood on end giving necessary components of a formidable defensive wall of which the "security screen" of the bench seat may or may not be integrally used.

Since certain changes may be made in the above described security bench, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An article of furniture for use in securing an area against unauthorized vehicular access and/or explosive force, comprising:

a support base having a top side, wherein the support base is I-shaped and comprises an elongate transverse section, a first end support attached to one end of the transverse section, and a second end support attached to the other end of the transverse section, wherein the first and second end supports are securely connected to the transverse section to establish a unitary mass resistant to explosive and vehicular forces;

a frame having a perimeter and a central opening, wherein the frame is rectangular and overlaps the top side of the support base; the frame being securely attached to the support base to reinforce the structural integrity of the base;

a screen attached to the frame and covering the central opening, wherein the frame and screen are positioned against the top side of the support base; the frame being attached to the support base, and the frame and screen being configured to accommodate explosive debris and force;

a seating surface positioned on top of the frame and attached to one of the frame and the support base; and the transverse section extends past the seating surface to form a backrest.

2. An article of furniture for use in securing an area against unauthorized vehicular access and/or explosive force, comprising:

an I-shaped support base having a transverse section extending between two end portions and a top side;

a frame having a perimeter and a central opening;

a screen attached to the frame and covering the central opening, wherein the frame and screen are positioned against the top side of the support base; the frame being attached to the support base, and the frame and screen being configured to accommodate explosive debris and force;

a seating surface positioned on top of the frame and attached to one of the frame and the support base; and the transverse section extends past the seating surface to form a backrest.

3. An article of furniture for use in securing an area against unauthorized vehicular access and/or explosive force, comprising:

a support base having a top side, wherein the support base has a hollow interior for filling with a ballast material and the base top side comprises a hinged top panel for accessing the hollow interior to use the support base as a storage container;

a frame having a perimeter and a central opening;

a screen attached to the frame and covering the central opening, wherein the frame and screen are positioned against the top side of the support base; the frame being attached to the support base, and the frame and screen being configured to accommodate explosive debris and force; and a seating surface positioned on top of the frame and attached to one of the frame and the support base.

* * * * *